US005288534A

United States Patent [19]

Tavshanjian

[11] Patent Number: 5,288,534

[45] Date of Patent: Feb. 22, 1994

[54] HANDY, MULTI-PUPOSE TILE INSTALLATION SPACERS

[76] Inventor: B. Armen Tavshanjian, 10 Amanda Dr., Manchester, Conn. 06040

[21] Appl. No.: 997,056

[22] Filed: Dec. 28, 1992

[51] Int. Cl.[5] ..... G01B 3/00; B32B 3/02

[52] U.S. Cl. ..... 428/64; 428/66; 428/120; 428/119; 52/DIG. 1; 33/526; 33/527; 33/518; 33/DIG. 20

[58] Field of Search ..... 428/64, 66, 120, 119; 33/526, 527, DIG. 20, 518; 52/DIG. 1

[56] References Cited

U.S. PATENT DOCUMENTS 927,499 7/1909 Davis ..... 428/64

4,955,142 9/1990 Rieck ..... 33/526

*Primary Examiner*—Alexander S. Thomas

*Attorney, Agent, or Firm*—M. P. Williams

[57] ABSTRACT

A tile spacer includes a platform (10) having opposite coplanar surfaces (11, 12) on which are disposed a straight spacer (13) and a corner spacer, either a cross-shaped spacer (14) or a tee-shaped spacer 15, respectively. One leg of the corner spacer (14, 15) is coaligned with the straight spacer (13) so as to assist in aligning either of the spacers while using the other spacer as a handle. The spacer (13) and the coaligned leg of the spacers (14, 15) may extend beyond the platform so as to assist aligning the spacer (13) when using the spacer (14, 15) as a handle.

10 Claims, 3 Drawing Sheets

HANDY, MULTI-PUPOSE TILE INSTALLATION SPACERS

TECHNICAL FIELD

This invention relates to spacers used when installing ceramic tile, brick, block and the like.

BACKGROUND ART

In the process of covering floor, wall and counter surfaces with ceramic tile and the like, individual tiles, or sheets of mosaic glued to a mesh webbing, are individually set into either some form of adhesive, or some form of mortar. In the process of setting the individual pieces, it is known to use tile spacers to assist in achieving uniformly sized grout spacing between the tiles or sheets of mosaic. These are typically in the shape of a cross, so as to define a corner where four tiles will intersect. One leg of the cross can be cut off, making a T spacer, which can be used when an offset layup is utilized, with T-shaped grout spaces at the intersection of three tiles. The spacers are typically made of semi-rigid plastic having depths ranging from ⅛ to 3/16 of an inch, with spacing widths of between 1/16 of an inch and ⅜ of an inch. For brick, cement block and larger tiles, larger sizes of spacers, with considerably more depth, are used.

The spacers are sometimes used edgewise as an aid to laying out an array of tiles where a long row of dry tiles can be laid out, set apart by the edgewise spacers. Such spacers also are sometimes used edgewise as stacking spacers for vertical installations (wall tiles).

Most tile layers have large, heavily callused fingers and find the spacers hard to handle. The spacers must be removed from the grooves between the tiles after the tiles are set, by means of a pick, thin spatula, or other spacer remover tools. When working with the spacers, it is difficult to handle them and move them around. Additionally, they provide no guide to the depth of the lay of the tiles (the uniformness of the final finish across several tiles) as the job proceeds.

DISCLOSURE OF INVENTION

Objects of the invention include provision of tile spacers which are easy to handle, which are easily removed after use, which assist in establishing a uniform lay of the tiles, and which can serve as a stacking spacer for vertical installations and as a layout spacer that is easily handled.

According to the present invention, a tile spacer includes a thin, semi-rigid platform having a straight tile spacer on one side thereof and a corner tile spacer on the other side thereof; the corner spacer may be cross-shaped or tee-shaped.

The platform, which may typically be disk-like, assists in establishing a uniform lay of tiles, and holds a portion of the spacer up above the tiles so it is accessible for removal. The straight spacer is used principally as a handle, when the cross shaped spacer is used to space the intersection of four tiles, or when the tee-shaped spacer is used to space the intersection of three tiles. The straight spacer also serves as a stacking spacer for vertical tile installations and as a job layout spacer. The spacer in accordance with the present invention is easily handled since it can be gripped by the handle when being inserted for use and when being removed. It is also more easily removed once its purpose has been served. A single spacer can serve for corner either cross or tee as the case may be), as well as for straight spaces. The spacer in accordance with the present invention is scalable to suit a variety of uses, including tile, stone, slate, brick and block, etc.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
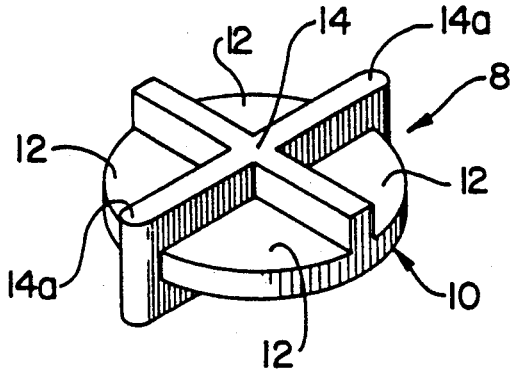
FIG. 1 is a bottom perspective view of a cross-shaped spacer in accordance with the present invention.
Figure 2:
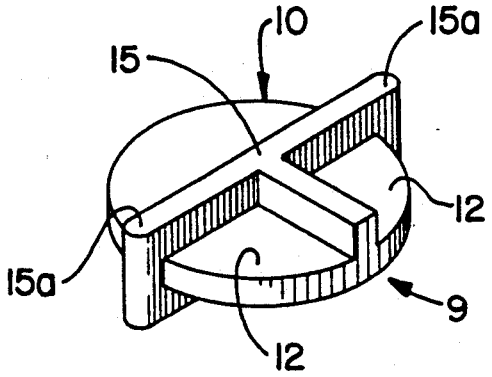
FIG. 2 is a bottom perspective view of a tee-shaped spacer in accordance with the present invention.
Figure 3:
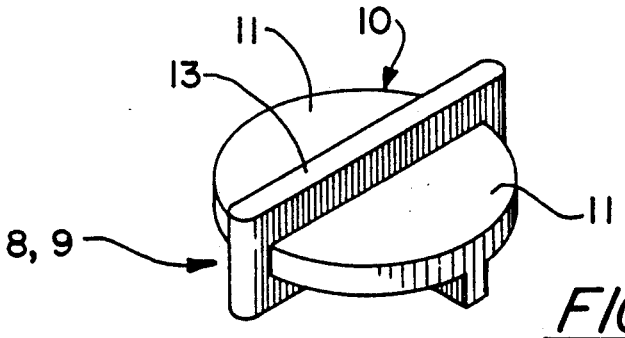
FIG. 3 is a top perspective view of both the spacers of FIGS. 1 and 2.

Referring to FIGS. 1–3, the tile spacers 8, 9 in accordance with the present invention include a platform portion 10 which has coplanar, flat surfaces 11, 12 on opposite faces thereof. Elongated, raised ridges extend outwardly of the faces of the platform 10 to form a straight spacer element 13 and corner spacer elements 14, 15 extending across the surface 11, 12, respectively. The platform portion 10 and ridges 13–15 are all made of a unitary piece of semi-rigid material, such as plastic. The corner spacer elements 14, 15 have legs that are mutually, orthogonally transverse to each other in the form of a cross (14) or a tee (15). In the embodiment disclosed herein, the platform 10 is a disk, although it need not necessarily be. It could be square with the corners at the spacer elements 13, 14, a square with the spacers bisecting the sides, or any other shape that will provide a reasonable platform. The straight spacer element 13 is coaligned with one leg 14*a*, 15*a* of the corner spacer element 14, 15 so as to permit orienting either the corner spacer element 14, 15 or the straight spacer element 13 with respect to the file being laid, while using the other spacer element as a handle. In the disclosed embodiment, the length of the straight spacer element 13 and the coaligned leg 14*a*, 15*a* of the corner spacer element 14, 15 extends beyond the edge of the platform 10, so that the orientation of the straight spacer element 13 can be known, even when below the platform, as it is when used as described with respect to FIGS. 6 and 7, hereinafter. For normal tile (such as is used on kitchen counters and for bathroom walls and floors) the spacer may have a platform on the order of one inch in diameter, and the straight spacer element 13 may therefore be just under 1⅛ inch in length. The platform may be about 1/16 inch thick, or it may be thicker, up to about ⅛ inch. The dimensions of the elements 13, 14 can typically be essentially the same as the simple tile spacers available in the prior art, which resemble the cross-shaped spacer element 14 herein. That is, the grouting width to be achieved and therefore the width of the spacer may range from 1/32 of an inch up to ¼ of an inch, or more, and the depth may vary from about ⅛ of an inch to ¼ of an inch, or more, depending upon what the spacers are to be used for. Of course, much larger spacers will be used to handle cement block, glass brick and the like.

Figure 4:
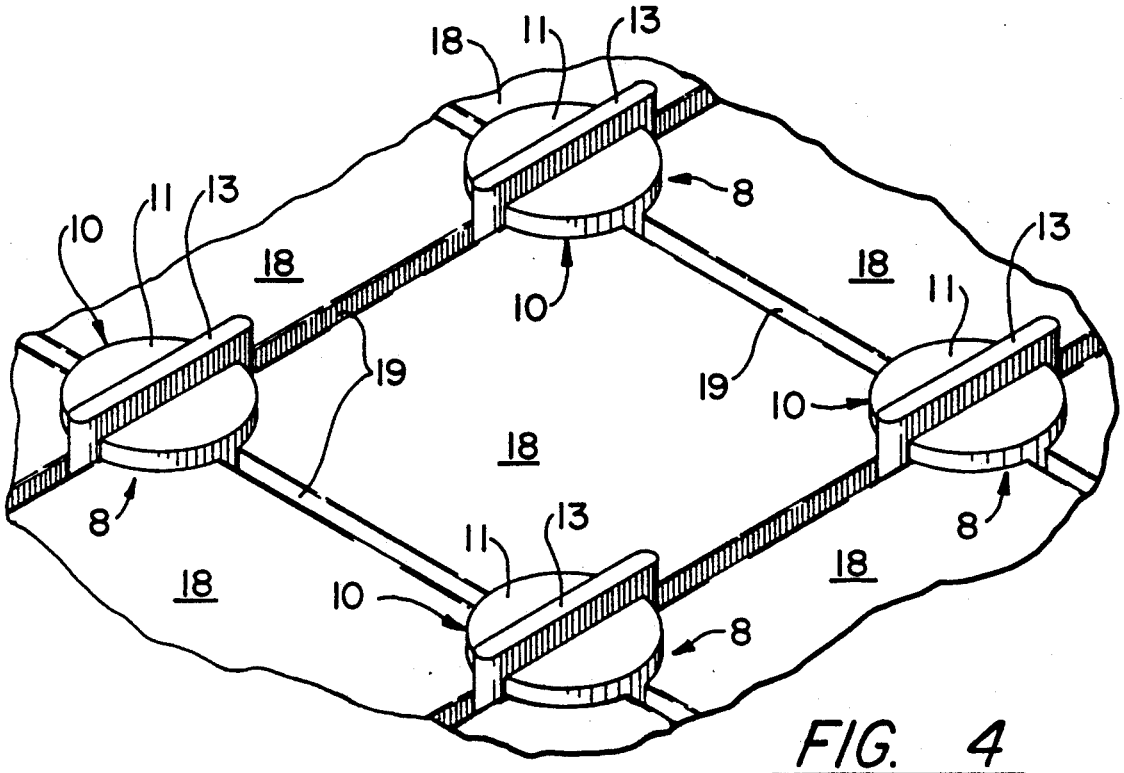
FIG. 4 is a bottom plan view of the spacer of FIG. 1.

An illustration of the typical use of the spacer 8 of FIG. 1, to line up an orthogonal, symmetrical array of tiles 18, is shown in FIG. 4. Therein, the spacer 8 is in the position shown in FIG. 3, with the cross-shaped spacer element 14 facing downward, and the straight spacer element 13 being used as a handle. Notice that the spacer 8, 9 not only assists in laying out the spacing between the tiles 16 so as to provide an orthogonal arrangement with uniform grout spaces 19, but it also establishes a uniform lay (without lippage) by assisting in causing the off-surface displacement of the tips of the tiles 16 to be more nearly uniform. If any of the tiles 16 are not laying flat, the uneven lay of the spacer is readily apparent, and the spacer can be easily removed so as to correct the lippage.

Figure 5:
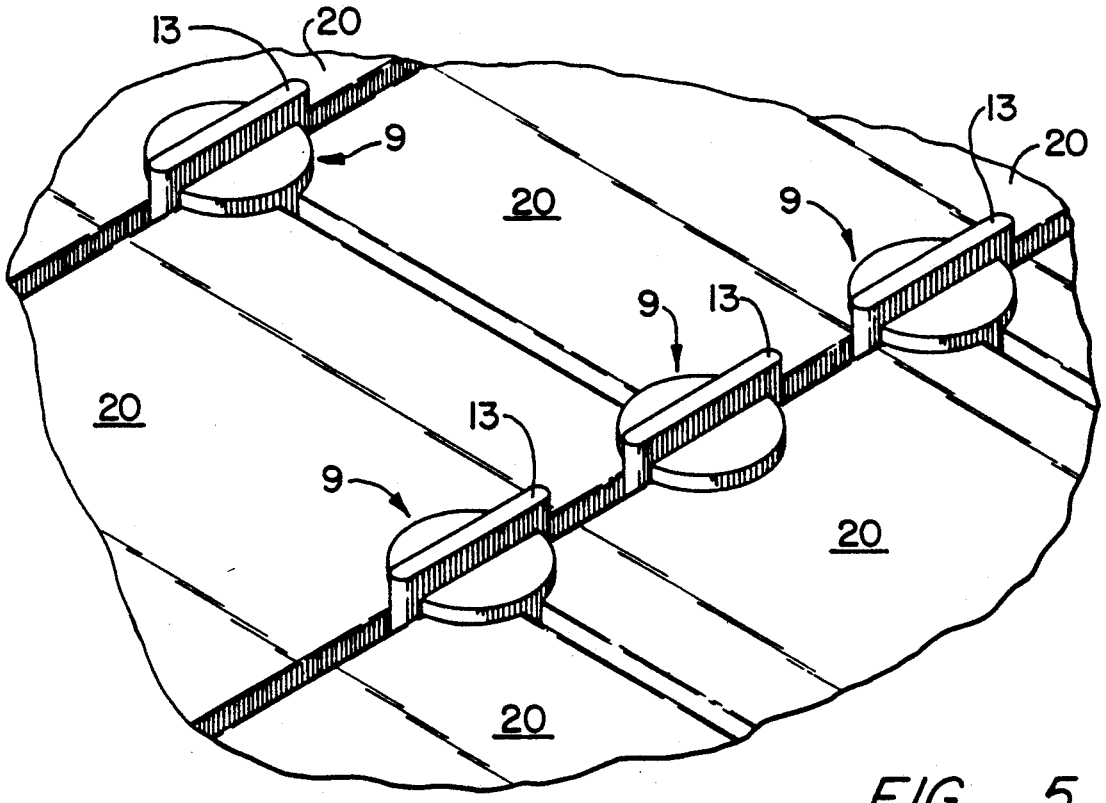
FIG. 5 is a bottom, perspective view of the spacer of FIG. 1.
Figure 6:
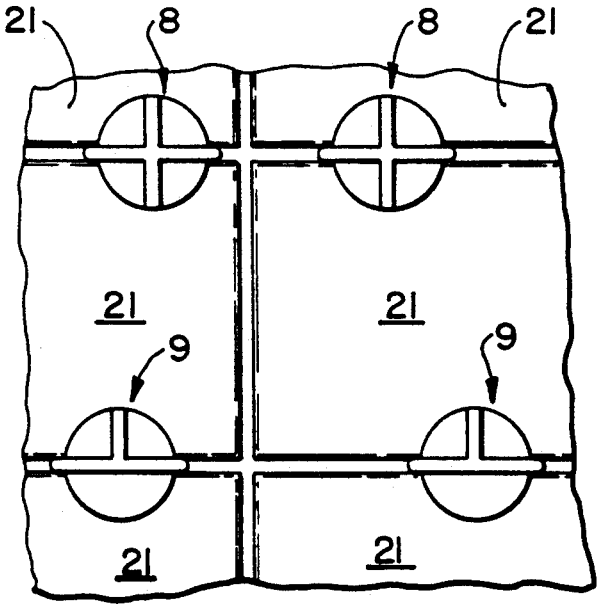
FIG. 6 is an illustration of a pair of spacers in accordance with the invention in use setting tile.
Figure 7:
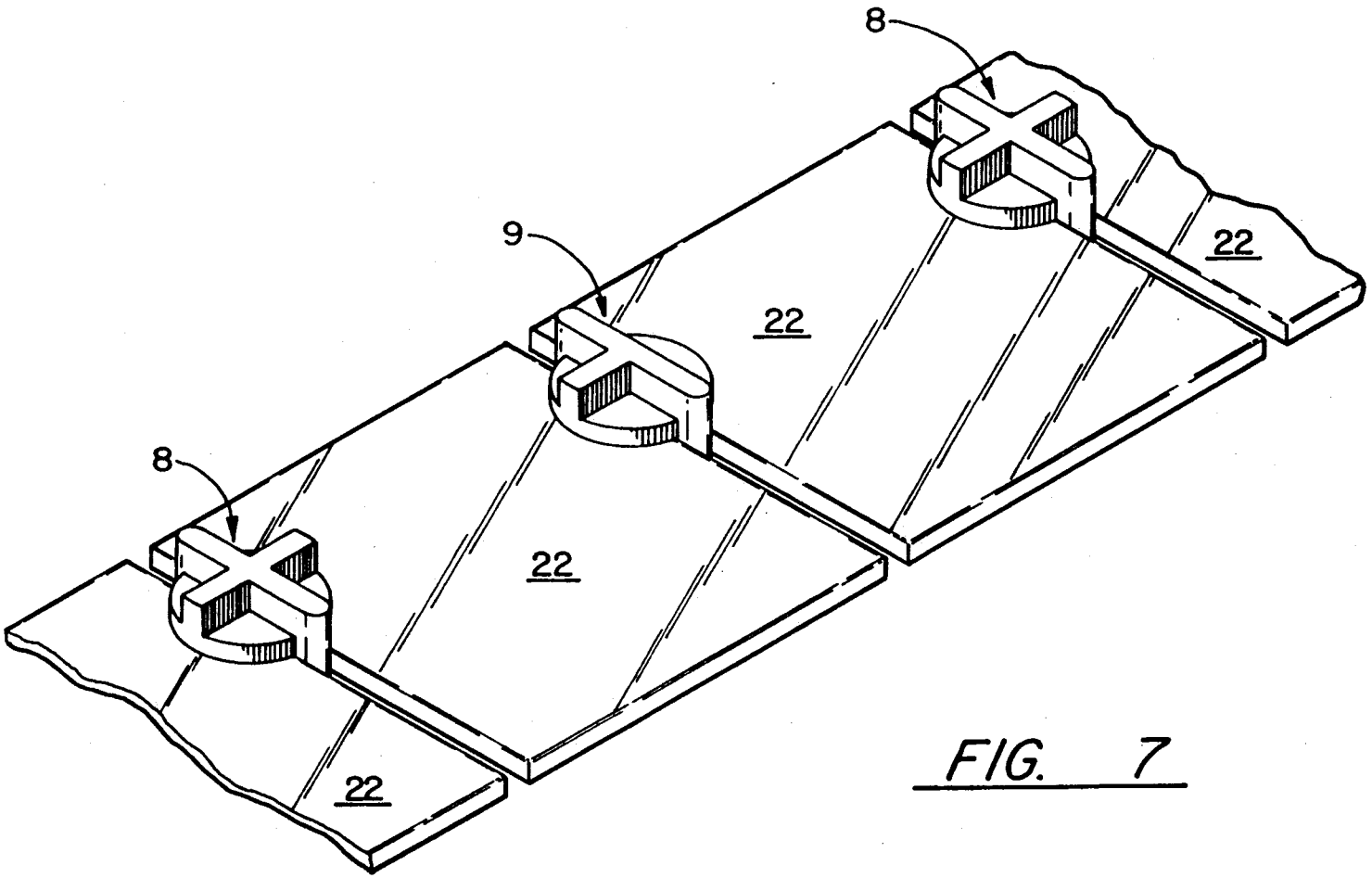

In FIG. 5, the tee-shaped spacer 9 is face down (as in FIG. 3) to align an orthogonal, offset array of tiles 20. In FIG. 6, the spacers 8, 9 are being used in the position of FIGS. 1 and 2 as stacking spacers for wall tiles 21. Of course, t he spacer of FIG. 1 could be used in the corners as well as or instead of the straight spacers. In FIG. 7, the spacers 8, 9 are being used in the position of FIGS. 1 and 2 as floor layout spacers, to assist in determining the span of a pattern of tiles 22. The spacers 8, 9 can be used as shown in FIGS. 6 and 7 to help provide minimum grout spaces when laying slate and the like. Thus, the spacers are easy to handle while being used for a variety of purposes.

In each case, the coaligned leg of the corner spacers and the straight spacer need not extend past the platform, if not desired in any use of the invention, or all of the legs may extend past the platform, if desired. The corner spacer could be wye-shaped, or any other desired shape.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A tile spacer formed of a single piece of semi-rigid material comprising:

a platform portion having coplanar, flat surfaces disposed on opposite faces thereof;

a straight spacer element comprising a raised rigid extending outwardly from and substantially across one of said surfaces; and a corner spacer element comprising a pair of raised transverse ridges extending outwardly from and substantially across the other of said surfaces;

said spacer elements having a depth extending outwardly of said surfaces which is a significant fraction of the depth of the tile to be spaced thereby and a width equal to the width of intertile grout line which is intended to separate the tiles to be spaced thereby.

2. A tile spacer according to claim 1 wherein said corner spacer element comprises a cross-shaped spacer element.

3. A tile spacer according to claim 1 wherein said corner spacer element comprises a tee-shaped spacer element.

4. A tile spacer according to claim 1 comprised of semi-rigid plastic.

5. A tile spacer according to claim 1 wherein at least one of said spacer elements extends slightly beyond the surfaces of said platform portion so as to be visible from the opposite side of said platform.

6. A tile spacer according to claim 1 wherein said platform portion is a disk.

7. A tile spacer according to claim 6 wherein said platform portion is a disk of about one inch diameter.

8. A tile spacer according to claim 1 wherein said platform portion is about 1/16 inch thick.

9. A tile spacer according to claim 1 wherein said corner spacer element includes a pair of mutually perpendicular legs and said straight spacer element is coaligned with one leg of said corner spacer element.

10. A tile spacer according to claim 9 wherein said straight spacer element and said leg coaligned therewith extend beyond the edge of the platform so as to be visible from the opposite side of said platform.

* * * * *